US006304032B1

(12) United States Patent
Asano

(10) Patent No.: US 6,304,032 B1
(45) Date of Patent: Oct. 16, 2001

(54) PLASMA DISPLAY PANEL AND METHOD OF PRODUCING THE SAME

(75) Inventor: Toshiaki Asano, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/338,731

(22) Filed: Jun. 23, 1999

(30) Foreign Application Priority Data

Jun. 24, 1998 (JP) ..... 10-176486

(51) Int. Cl.[7] ..... H01J 9/24; H01J 61/42
(52) U.S. Cl. ..... 313/582; 445/24; 313/587
(58) Field of Search ..... 445/24; 313/582, 313/587

(56) References Cited

U.S. PATENT DOCUMENTS

| | | | | |
|---|---|---|---|---|
| 5,015,912 | * | 5/1991 | Spindt et al. | 313/495 |
| 5,448,133 | * | 9/1995 | Ise | 313/497 |
| 5,932,967 | * | 8/1999 | Chikazawa | 313/587 |
| 5,939,826 | * | 8/1999 | Ohsawa et al. | 313/587 |

FOREIGN PATENT DOCUMENTS

| | | |
|---|---|---|
| 54-61461 | 5/1979 | (JP) . |
| 58-12240 | 1/1983 | (JP) . |
| 7-14555 | 1/1995 | (JP) . |
| 8-138559 | 5/1996 | (JP) . |
| 9-245654 | 9/1997 | (JP) . |
| 10-228870 | 8/1998 | (JP) . |
| 10-302644 | 11/1998 | (JP) . |
| 11-31460 | 2/1999 | (JP) . |

* cited by examiner

*Primary Examiner*—Kenneth J. Ramsey
(74) *Attorney, Agent, or Firm*—Michael Best & Friedrich LLC Laff; J. Warren Whitesel

(57) ABSTRACT

A PDP (Plasma Display Panel) with high luminance and long service life is disclosed. Two substrates are positioned face to face and located at the scanning side and data side, respectively. A reflection layer for reflecting vacuum ultraviolet rays is formed on the surface of one substrate facing the other substrate located on the data side. The reflection layer has a laminate structure made up of alternating layers of two substances each having a particular refractive index. The reflection layer reflects ultraviolet rays reached the substrate on the scanning side toward the other substrate. As a result, the amount of ultraviolet rays to be incident to a phosphor and therefore the luminance of the PDP increases.

6 Claims, 4 Drawing Sheets

PLASMA DISPLAY PANEL AND METHOD OF PRODUCING THE SAME

BACKGROUND OF THE INVENTION

The present invention relates to a PDP (Plasma Display Panel) and more particularly to a PDP for transforming discharge emission to visible rays with a phosphor and a method of producing the same.

A PDP has been proposed in various forms in the past. With the spread of PDPs, a demand for PDPs usable in various environments is increasing. Specifically, while the application of PDPs has heretofore been limited to public display, it is now extended to personal television receivers. The prerequisite with PDPs for personal television receivers is that PDPs sufficiently adapt to environments in which they are situated. However, the problem with the conventional PDPs is that they consume great power in achieving high emission efficiency and high luminance. In addition, the resulting heat radiation reduces the durability, i.e., service life of the PDPs.

Technologies relating to the present invention are disclosed in, e.g., Japanese Patent Laid-Open Publication Nos. 57-25651, 62-257862, 2-148559, 2-201860, 4-133004, 8-96751, and 9-231910.

SUMMARY OF THE INVENTION

It is therefore an object of the present invention to provide a PDP having high luminance and long service life.

In accordance with the present invention, a PDP includes a pair of glass substrates respectively located at a scanning side and a data side and facing each other with the intermediary of a preselected gas discharge space. A phosphor layer is formed on at least one of the two glass substrates. A reflection layer is formed on the surface of the other glass substrate facing the one glass substrate for reflecting vacuum ultraviolet (UV) rays.

Also, in accordance with the present invention, a method of producing a PDP includes the steps of positioning a pair of glass substrates face to face while forming a preselected gas discharge space between the glass substrates, forming a phosphor layer on at least one of the glass substrates, and forming a reflection layer on the surface of the other glass substrate facing the one glass substrate for reflecting vacuum UV rays.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
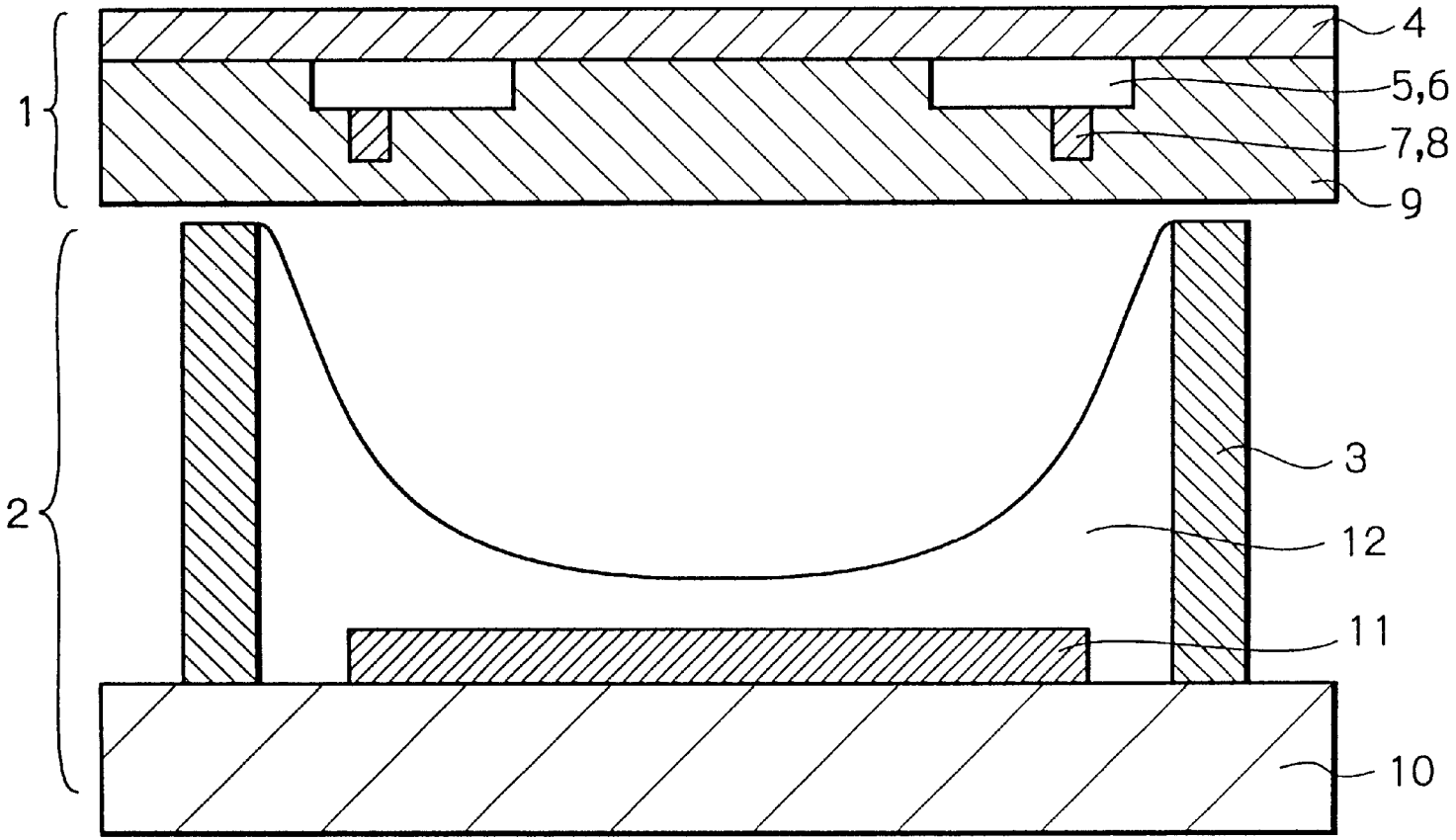
Fig. 1 PRIOR ART
FIG. 1 is a fragmentary section showing a conventional PDP.

To better understand the present invention, brief reference will be made to a conventional reflection type PDP, shown in FIG. 1. As shown, the PDP includes a front plate 1 and a rear plate 2 located at the scanning side and data side, respectively. The front plate 1 and rear plate 2 face each other with the intermediary of walls 3. The space delimited by the plates 1 and 2 and walls 3 are filled with gas having an emission spectrum in a vacuum UV range, e.g., He—Ne—Xe Penning gas.

Specifically, the front plate 1 on the scanning side includes a glass substrate 4 on which transparent electrodes 5 and 6 are formed. Trace electrodes or discharge electrodes 7 and 8 are respectively formed on the transparent electrodes 5 and 6 for improving conductivity. A dielectric layer 9 covers the transparent electrodes 5 and 6 and trace electrodes 7 and 8. The rear plate 2 on the data side is made up of a glass substrate 10, a write electrode 11 formed on the glass substrate 11, and a phosphor 12.

In operation, a high voltage is applied between the trace electrodes 7 and 8 and the write electrode 11 for effecting write discharge. Subsequently, a high AC voltage is applied between the trace electrodes 7 and 8 with the result that the above discharge continues because of a memory effect available with wall charge. Vacuum UV rays resulting from the discharge cause the phosphor 12 provided on the rear plate 2 to emit light.

The above conventional PDP has some problems left unsolved, as discussed earlier.

In accordance with the present invention, a PDP includes a pair of glass substrates facing each other with the intermediary of a preselected gas discharge space. A phosphor layer is formed on at least one of the glass substrates. A reflection layer is formed on the surface of one glass substrate facing the other glass substrate located at the data side for reflecting vacuum UV rays.

Usually, a PDP emits vacuum UV rays in the event of gas discharge and causes a phosphor provided on a rear plate to emit with the vacuum UV rays. The vacuum UV rays propagate from the discharge position toward both of the rear plate and a front plate located on the scanning side. A glass substrate included in the front plate has a high absorption factor in the wavelength range of the vacuum UV rays and therefore prevents the UV rays from contributing to the emission of a phosphor. By providing a reflection layer on the surface of the front substrate, it is possible to effectively use the vacuum UV rays heretofore simply wasted for the emission of the phosphor.

A reflection layer is generally implemented by a thin metal film. It is necessary with a PDP to form the reflection layer on the surface to be observed and to realize transmissivity for visible rays high enough to guarantee luminance. Therefore, the metal film for this application should be extremely thin. Further, because the reflection layer is located in the vicinity of discharge electrodes, a conductive substance would disturb discharge. A laminate mirror for use in, e.g., a spectroscope is a specific form of a reflection layer meeting the above requirements. The laminate mirror is made up of alternating layers of two or more substances each having a particular refractive index.

A discharge tube with the above laminate mirror is disclosed in, e.g., Laid-Open Publication Nos. 8-96751, 4-133004, 2-201860 and 2-148559 mentioned earlier.

Reflectivity in the vacuum UV range available with most substances other than metals is so low, high reflectively cannot be easily implemented by a single layer. However, in the laminate mirror, light reflected from the interfaces between different kinds of substances intensify each other due to interference. The laminate mirror therefore achieves high reflectivity if it is configured to maximize the reflectivity of the entire laminate. The interference is maximum when the length of the light propagation is n/4 of the wavelength to be reflected by a desired substance, as well known as a Bragg's condition. Naturally, the desired substance should preferably have high transmissivity for vacuum UV rays and high band gap energy.

The above substance may be any one of compounds of light metals whose atomic numbers are smaller than 20 inclusive, e.g., lithium fluoride (LiF), beryllium fluoride (BeF), magnesium fluoride ($MgF_2$), sodium fluoride (NaF), calcium fluoride ($CaF_2$), beryllia (BeO), magnesia (MgO), alumina ($Al_2O_3$), silica ($SiO_2$), potassium chloride (KCl) and sodium chloride (NaCl). Use may also be made of barium fluoride ($BaF_2$), barium-strontium oxide (BaSrO) or similar compound of heavy metal and light metal.

The innermost surface of the reflection layer included in the PDP is exposed to discharge plasma of high energy and must therefore withstand ion sputter. Another important requisite is that the secondary electron discharge coefficient be great enough to implement a desired discharge characteristic. MgO, MgF2 and BaSrO are specific compounds meeting the above requisite; the secondary electron discharge coefficient should preferably be greater than 0.2.

Figure 2:
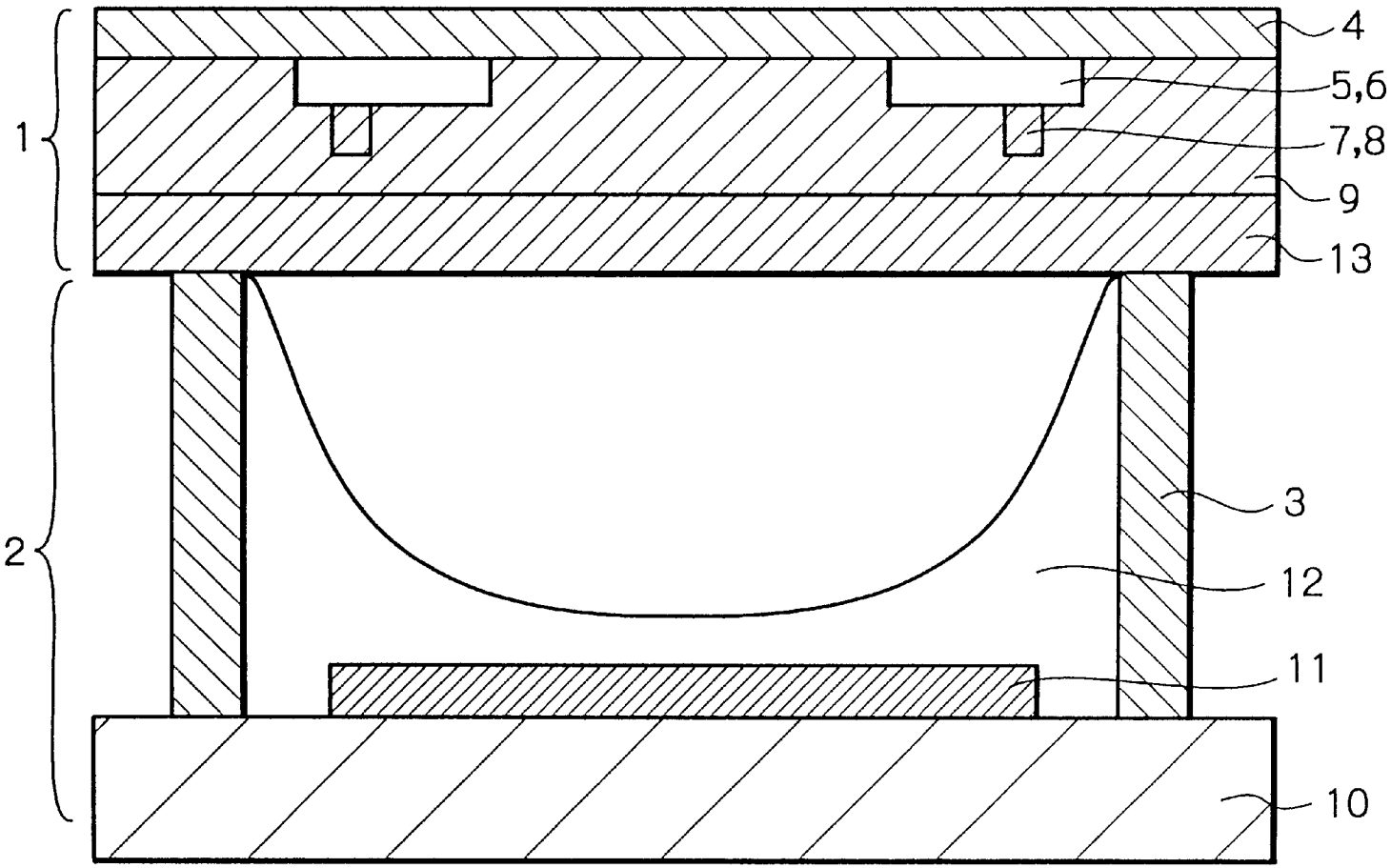
FIG. 2 is a fragmentary section showing a PDP embodying the present invention.

Referring to FIG. 2, a PDP embodying the present invention is shown and includes a front plate 1 and a rear plate 2 located at the scanning side and data side, respectively. The front plate 1 and rear plate 2 face each other with the intermediary of walls 3. The space delimited by the plates 1 and 2 and walls 3 is filled with gas having an emission spectrum in the vacuum UV range, e.g., He—Ne—Xe Penning gas.

Specifically, the front plate 1 on the scanning side includes a glass substrate 4 on which transparent electrodes 5 and 6 are formed. Trace electrodes or discharge electrodes 7 and 8 are formed on the transparent electrodes 5 and 6 for improving conductivity. A dielectric layer 9 covers the transparent electrodes 5 and 6 and trace electrodes 7 and 8. A reflection layer 13 is formed on the dielectric layer, or surface layer, 9 for reflecting vacuum UV rays directed toward the front plate 1. The rear plate 2 on the data side is made up of a glass substrate 10, a write electrode 11 formed on the glass substrate 10, and a phosphor 12.

In operation, a high voltage is applied between the trace electrodes 7 and 8 and the write electrode 11 for effecting write discharge. Subsequently, a high AC voltage is applied between the trace electrodes 7 and 8 with the result that the above discharge continues because of a memory effect available with wall charge. Vacuum UV rays resulting from the discharge causes the phosphor 12 provided on the substrate 2 to emit light.

Figure 3A:
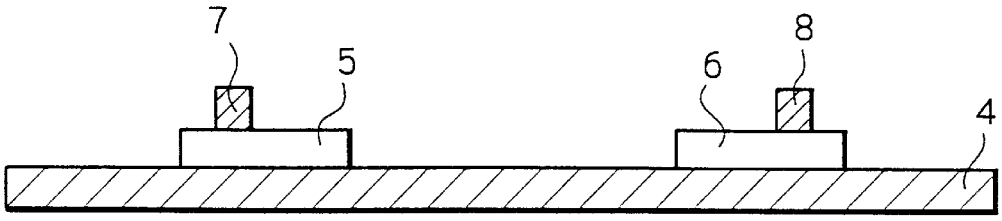
FIGS. 3A–3C and 4A–4C are sections demonstrating a specific procedure for producing the PDP shown in FIG. 2.

A specific procedure for producing the PDP shown in FIG. 2 will be described with reference also made to FIGS. 3A–3C and 4A–4C. First, two soda glasses (glass substrates 4 and 10) are prepared. An ITO (indium oxide) film is formed on one of the two soda glasses and then etched to form the transparent electrodes 5 and 6. Subsequently, the trace electrodes 7 and 8 are respectively formed on the transparent electrodes 5 and 6 in the form of a silver pattern. This stage of the procedure is shown in FIG. 3A.

Figure 3B:
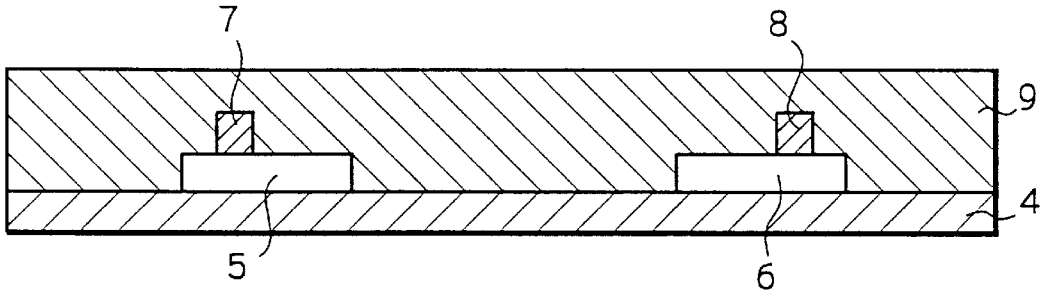
Figure 3C:
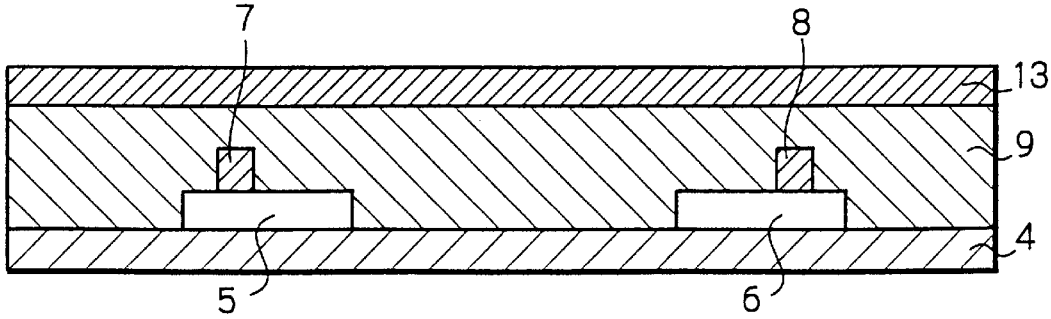

As shown in FIG. 3B, the dielectric layer 9 is formed on the above laminate by use of a lead-containing glass frit having a low melting point. Then, fifteen $MgF_2$ layers which are 220 Å thick each and fifteen LiF layers which are 250 Å thick each are alternately laminated on the dielectric layer 9 by electron beam deposition. Thereafter, MgO is deposited on the top of the alternating $MgF_2$ and LiF layers, completing the reflection layer 13. FIG. 30 shows the resulting front plate 1 to be located on the scanning side.

Figure 4A:
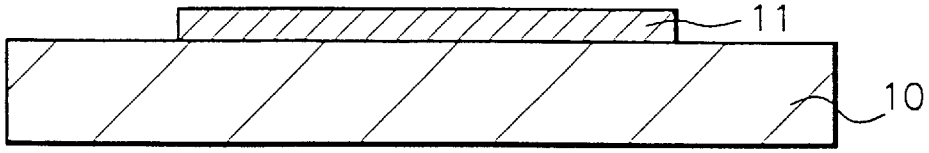
Figure 4B:
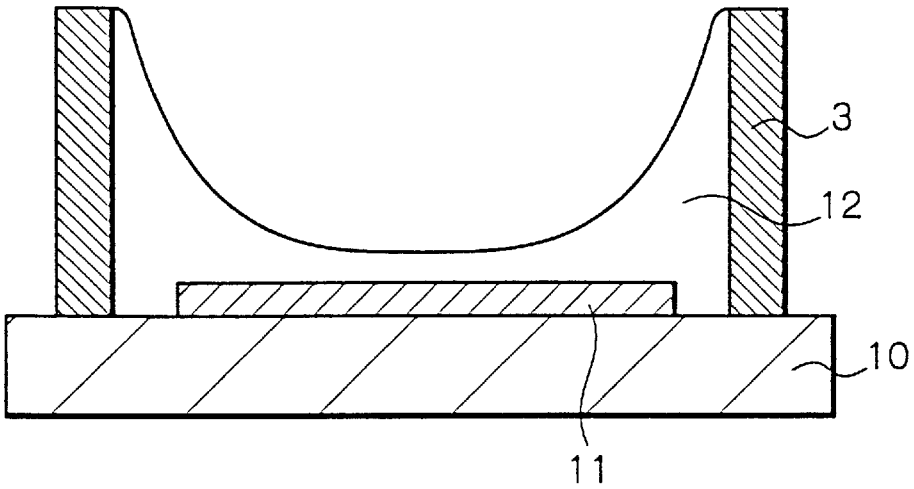
Figure 4C:
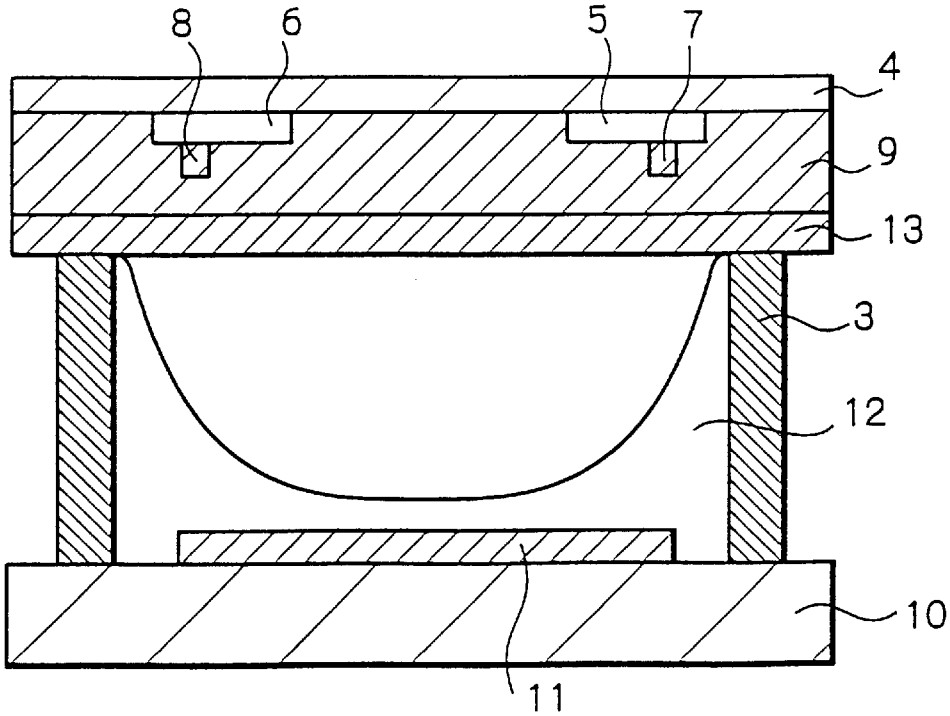

As shown in FIG. 4A, the write electrode 11 is formed on the other glass substrate 10 by screen printing, and then the walls 3 are formed by using a glass frit. As shown in FIG. 4B, the phosphor 12 is printed and baked between the walls 3, completing the rear plate 2 to be located at the data side. After the two plates 1 and 2 have been connected together, the space between them is exhausted and then filled with the He—Ne—Xe Penning gas so as to form the PDP, as shown in FIG. 4C.

To determine the effect of the reflection layer 13, one half of the surface of the front plate 1 was masked so as not to form the laminate reflection layer 13. Luminance comparison showed that the reflection layer 13 increased luminance by 8.5%.

Luminance was also improved when an NaCl film was formed on the top of the laminate reflection layer 13. In this case, however, luminance started to fall just after the start of emission, and the NaCl film sequentially disappeared. This kind of assembly therefore does not withstand a long time of use.

An alternative embodiment of the present invention will be described hereinafter. Two low alkaline glasses, e.g., glass sheets PD-200 available from Asahi Glass Co., Ltd. are prepared. An ITO film is formed on one of the two glasses by sputtering and then etched to form the transparent electrodes 5 and 6. Then, the trace electrodes 7 and 8 are respectively formed on the transparent electrodes 5 and 6 by screen printing in the form of a silver pattern. Subsequently, the dielectric layer 9 is formed by using a bismuth-containing glass frit having a low melting point. Twenty-five $SiO_2$ layers which are 170 Å each and twenty-five LiF layers which are 250 Å each are alternately laminated on the dielectric layer 9 by CVD (Chemical Vapor Deposition). Then, MgO and $MgF_2$ are deposited together on the top of the alternating $SiO_2$ and the LiF laminate so as to complete the reflection layer 13. The glass with the above layers is used as the front plate 1 to be located on the scanning side.

The write electrode 11 is formed on the other glass (glass substrate 10) by photoprinting, and then the walls 3 are formed by using a glass frit. Then, the phosphor 12 is printed and baked between the walls 3, completing the rear plate 2 to be located on the data side. After the two plates 1 and 2 have been connected together, the space between them is evacuated and then filled with He—Ne—Xe Penning gas.

To determine the effect of the reflection layer 13 included in the above alternative embodiment, part of the surface of the front plate 1 was masked so as not to form the laminate reflection layer 13. Luminance comparison showed that the reflection layer 13 increased luminance by 15%. On the other hand, the PDP was destroyed to compare the part having the reflection film 13 and the other part with respect to the transmissivity of the front plate 1. The part with the reflection film 13 was found to be lower in transmissivity than the part without the reflection film 13 by 9%.

It was found by the above experiments that the utilization ratio of the part contributing to the emission of vacuum UV rays was improved by 24%. A laminate reflection film 13 made up of 100 layers simply lowered luminance. This is presumably because an increase in the number of layers constituting the reflection film 13 lowers the transmissivity for visible rays and thereby degrades the improved luminance achievable with the reflection of vacuum UV rays. Because the transmissivity for visible rays depends on the substances constituting the reflection layer 13, a optimal number of layers and optimal film thickness must be selected for improving luminance by a tradeoff between the luminance and the reflectivity.

In summary, it will be seen that the present invention provides a PDP achieving improved emission efficiency and therefore lowered power consumption and heat radiation. The PDP can therefore be extensively used in various environments. In addition, the PDP of the present invention has high luminance and long service life.

Various modifications will become possible for those skilled in the art after receiving the teachings of the present disclosure without departing from the scope thereof.

What is claimed is:

1. A PDP (Plasma Display Panel) comprising:

a pair of glass substrates respectively located at a scanning side and a data side and facing each other with the intermediary of a preselected gas discharge space;

a phosphor layer formed on at least one of said pair of glass substrates;

a reflection layer formed on a surface of the other glass substrate facing the one glass substrate for reflecting vacuum ultraviolet (UV) rays, wherein said reflection layer has a laminate structure made up of alternating layers of at least two substrates, each substance having a particular refractive index, and wherein each of the at least two substances has a high transmissivity for vacuum UV rays and high band gap energy.

2. A PDP as claimed in claim 1, wherein the substance forming a surface of said reflection layer comprises one of an oxide, a fluoride and a chloride having a secondary electron emission coefficient greater than 0.2 inclusive.

3. A PDP as claimed in claim 2, wherein the at least two substances each have a high transmissivity for vacuum UV rays and high band gap energy.

4. A method of producing a PDP, comprising the steps of:

(a) positioning a pair of glass substrates face to face while forming a preselected gas discharge space between said pair of glass substrates;

(b) forming a phosphor layer on at least one of said pair of glass substrates;

(c) forming a reflection layer on a surface of the other glass substrate facing the one glass substrate for reflecting UV rays, wherein step (c) further comprises forming a laminate structure made up of alternating layers of at least two substances each having a particular refractive index, and wherein each of the at least two substances has a high transmissivity for vacuum UV rays and high band gap energy.

5. A PDP as claimed in claim 4, wherein the substance forming a surface of said reflection layer comprises one of an oxide, a fluoride and a chloride having a secondary electron emission coefficient greater than 0.2 inclusive.

6. A PDP as claimed in claim 5, wherein the at least two substances each have a high transmissivity for vacuum UV rays and high band gap energy.

* * * * *